US006883436B2

(12) United States Patent
Fuerst

(10) Patent No.: US 6,883,436 B2
(45) Date of Patent: Apr. 26, 2005

(54) TEMPLATE DOOR AND WING ASSEMBLY WITH BREAK-AWAY FEATURE FOR RAIL BALLAST REGULATOR

(75) Inventor: James William Fuerst, Wauwatosa, WI (US)

(73) Assignee: Nordco Inc., Oak Creek, WI (US)

( * ) Notice: Subject to any disclaimer, the term of this patent is extended or adjusted under 35 U.S.C. 154(b) by 0 days.

(21) Appl. No.: 10/446,944

(22) Filed: May 28, 2003

(65) Prior Publication Data

US 2004/0237829 A1 Dec. 2, 2004

(51) Int. Cl.[7] ..... E01B 27/16

(52) U.S. Cl. ..... 104/7.3; 104/279; 104/2; 37/281; 172/126

(58) Field of Search ..... 37/281, 104, 105, 37/10, 41; 172/126, 271, 311, 501; 104/7.1, 7.3, 2, 279

(56) References Cited

U.S. PATENT DOCUMENTS 4,019,268 A * 4/1977 Waterman ..... 37/219
4,249,325 A * 2/1981 Theurer ..... 37/104
4,275,514 A * 6/1981 Maura ..... 37/281
4,479,312 A * 10/1984 Turgeon ..... 37/219

* cited by examiner

*Primary Examiner*—Frantz F. Jules
(74) *Attorney, Agent, or Firm*—Greer, Burns & Crain, Ltd.

(57) ABSTRACT

A rail ballast wing assembly includes a outer door with at least one hinge edge, a template door pivotably secured to least one of the hinge edges and a positioning device associated with the outer door and the template door for maintaining an angular orientation of the template door relative to the outer door. A breakaway mechanism is connected to the positioning device and the template door and configured for temporarily disengaging the template door from the positioning device upon exposure to impact forces. The breakaway mechanism preferably includes a plate connecting the positioning device to the template door, and being disengageable from the template door. A top pin on the outer door is pivotably secured to a top plate through the use of at least one retainer bracket.

26 Claims, 5 Drawing Sheets

30
54
82
48
80
68
92
90
118
116
126
124
110
84
112
114
108
120
128
98
100
106
102
138
140
88
122
134
136
104
70
78
52
130
132
170

TEMPLATE DOOR AND WING ASSEMBLY WITH BREAK-AWAY FEATURE FOR RAIL BALLAST REGULATOR

BACKGROUND OF THE INVENTION

The present invention relates generally to railroad right of way maintenance machinery, and specifically to machinery used for forming and/or shaping rail track ballast in conjunction with railroad track repair, replacement or reconditioning.

Crushed rock rail ballast forms the support bed into which rail ties are inserted for receiving tie plates, spikes or other fasteners, and ultimately rail track. Ballast supports the weight of loaded trains, and also is sufficiently porous to remove standing water from the typically wooden ties. Also, the ballast provides the ability to maintain a constant rail/ground displacement or grading over varying terrain and soil conditions.

During railway maintenance operations, including but not limited to tie replacement, rail replacement or the like, the ballast becomes disrupted and must be reshaped. The optimal shape of rail ballast is a generally level upper surface in which the ties are embedded, and a pair of gradually sloping sides which flare out from ends of the rail ties at a specified angle or angular range which is generally constant across the railroad industry. However, depending on the application and available space, the angle of the ballast may vary.

To achieve the desired angular slope, self-propelled ballast regulators are employed, which feature at least one articulated, fluid-powered arm having at least one blade-like wing attached. Similar in function to a highway snowplow, the wing is oriented at a desired angle and is pushed by the ballast regulator through the ballast as the regulator moves along the track. To maximize the reuse of ballast stones dislodged during the regulation of the ballast, it is typical for an outer door to be provided with laterally oriented template doors. The template doors are pivotally connected to side edges of the outer door, and through the use of fluid-powered cylinders, the position of the template doors relative to the outer door can be adjusted to form "C-", "U-" or similarly shaped configurations to retain a supply of disrupted ballast as the regulator moves along the track. In this way, there is sufficient ballast to fill in any depressions encountered to maintain a uniform slope.

In addition, an inner door is positioned generally parallel to the track between the outer door and template doors and the track to prevent ballast stones from falling on the rails or damaging the regulator itself during operational speeds in the range of 10–25 mph. Both the template door assembly and the inner door are typically mounted upon a boom which is pivotally joined to the regulator machine and is held in operational position by at least one fluid-powered cylinder.

One disadvantage of conventional rail ballast regulator wing assemblies, is that during operation, the wing assemblies often encounter debris or fixed objects such as culverts, concrete barriers, curbs, rails, concrete construction debris or the like. Moving at the speeds referred to above, the regulator template doors have a significant amount of momentum. Accordingly, when the moving template doors impact fixed obstacles, they often become damaged, misaligned, skewed or otherwise disfigured to the extent that the ballast reconditioning operation must be suspended until repairs can be made. Due to the remote nature of railway maintenance, repairs are often not easily made.

In some cases, crews arrange for temporary repairs in the field which are often unsatisfactory in the type of ballast reshaping achieved after repair, or in unwittingly increasing the wear and tear on other machine components due to imbalances or misalignments. In other cases, bent or destroyed template doors are replaced using available materials which do not always achieve desirable ballast reconditioning. A frequently damaged area is the hinge between the outer door and the template door, which if not repaired correctly, causes poor reconditioning or other operational problems. Another frequently damaged area is the pivot joint where the outer door is secured to the boom. This joint typically includes a solid pivot pin welded to a top plate which in turn is secured to an end of the boom. Strong impacts are often transmitted through the template door to the outer door, where they are focused on this pivot point. Pins and/or template doors become bent or cracked, and smooth pivoting action is prevented.

Thus, there is a need for an improved rail ballast wing assembly which can better withstand operationally induced impacts. There is also a need for an improved rail ballast template door which can withstand impacts and be easily repaired in the field to maintain desired operational performance characteristics. Further, there is a need for a rail ballast outer door pivot arrangement which can better withstand such operational impacts.

BRIEF SUMMARY OF THE INVENTION

The above-listed needs are met or exceeded by the present rail ballast template door assembly which overcomes the limitations of the current technology. Among other things, the present assembly features a breakaway joint between the template door and the outer door, which receives the impact force and dissipates it by breaking, causing the template door to swing free of obstacles. The template door can then be easily reattached in the field by installing a new shear pin. In addition, the template doors are preferably provided with strengthened hinge points, support plates and a grader blade for greater reliability. Also, the outer door features a top plate boss which is pivotably sandwiched to an improved top plate assembly.

More specifically, a rail ballast wing or template door assembly includes an outer door with at least one hinge edge, a template door pivotably secured to the at least one edge, a positioning device associated with the outer door and the template door for maintaining an angular orientation of the template door relative to the outer door. A breakaway mechanism is connected to the positioning device and the template door and configured for temporarily disengaging the template door from the positioning device upon exposure to impact forces. The breakaway mechanism preferably includes a plate connecting the positioning device to the template door, and the plate being disengageable from the template door. A top pin on the outer door is pivotably secured to a top plate through the use of at least one retainer bracket.

In another embodiment, a template door configured for connection to an outer door of a rail ballast wing assembly includes a main panel having a front side, a rear side, a free edge and a hinge edge, a plurality of spaced, axially aligned hinge bores, each secured to the hinge edge with a transversely extending reinforcement tab for fastening to the template door, and at least one attachment point for receiving a positioning device for positioning the angular orientation of the template door to the outer door.

In yet another embodiment, an outer door is provided for use with a rail ballast regulator having a boom and wing assembly with at least one outer door having at least one template door pivotable relative to the at least one outer door. The outer door includes a main wall having a front surface, a rear surface and a pair of hinge edges, a generally perpendicularly disposed shoulder plate secured to an upper edge of the main wall, a top pin secured to and projecting from the shoulder plate, the top pin having a radially extending upper lip defining a space between the lip and the shoulder and a plurality of spaced, axially aligned hinge bores, secured to each hinge edge with a transversely extending reinforcement tab for fastening to the wall, the hinge bores constructed and arranged for engaging corresponding bores template doors associated with the outer door.

DETAILED DESCRIPTION OF THE INVENTION

Figure 1:
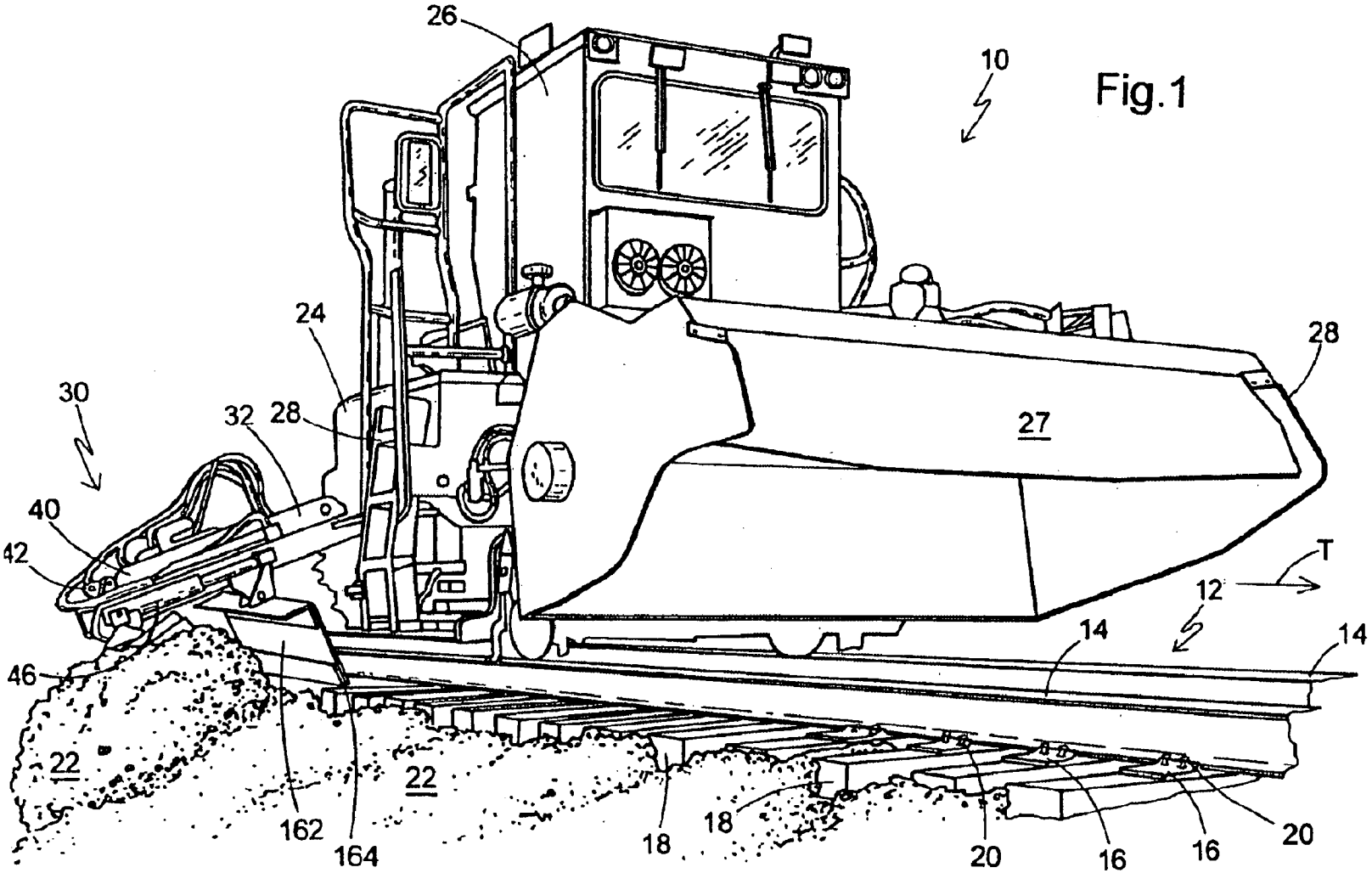
FIG. 1 is a rear perspective view of a rail ballast regulator suitable for use with the present wing assembly.

Referring now to FIG. 1, a railroad ballast regulator, generally designated 10, is shown disposed on a railroad track 12 having a pair of rails 14 mounted on tie plates 16 which are attached to typically wooden ties 18 by fasteners 20 such as rail spikes, lag screws or the like. The ties 18 are supported by particulate ballast 22, which is typically made of crushed rock.

The regulator 10 is preferably self-propelled through a power source 24 such as a diesel engine, but it is also contemplated that the machine could be towed along the track 12. An operator's cab 26 includes a control panel and other operator inputs (not shown) which are used to control the movement of the regulator 10 along the track 12, as well as the ballast regulating functions which will be described below. A broom 27 is preferably disposed at a rear of the regulator 10 for sweeping ballast 22 from the tops of the ties 18. Each of two sides 28 of the regulator 10 is preferably provided with a rail ballast wing assembly, generally designated 30, for regulating or shaping the ballast 22 on that side of the track 12, although a regulator with one wing assembly 30 is contemplated. Since both wing assemblies 30 are substantially identical, only one will be described in detail below.

Figure 2:
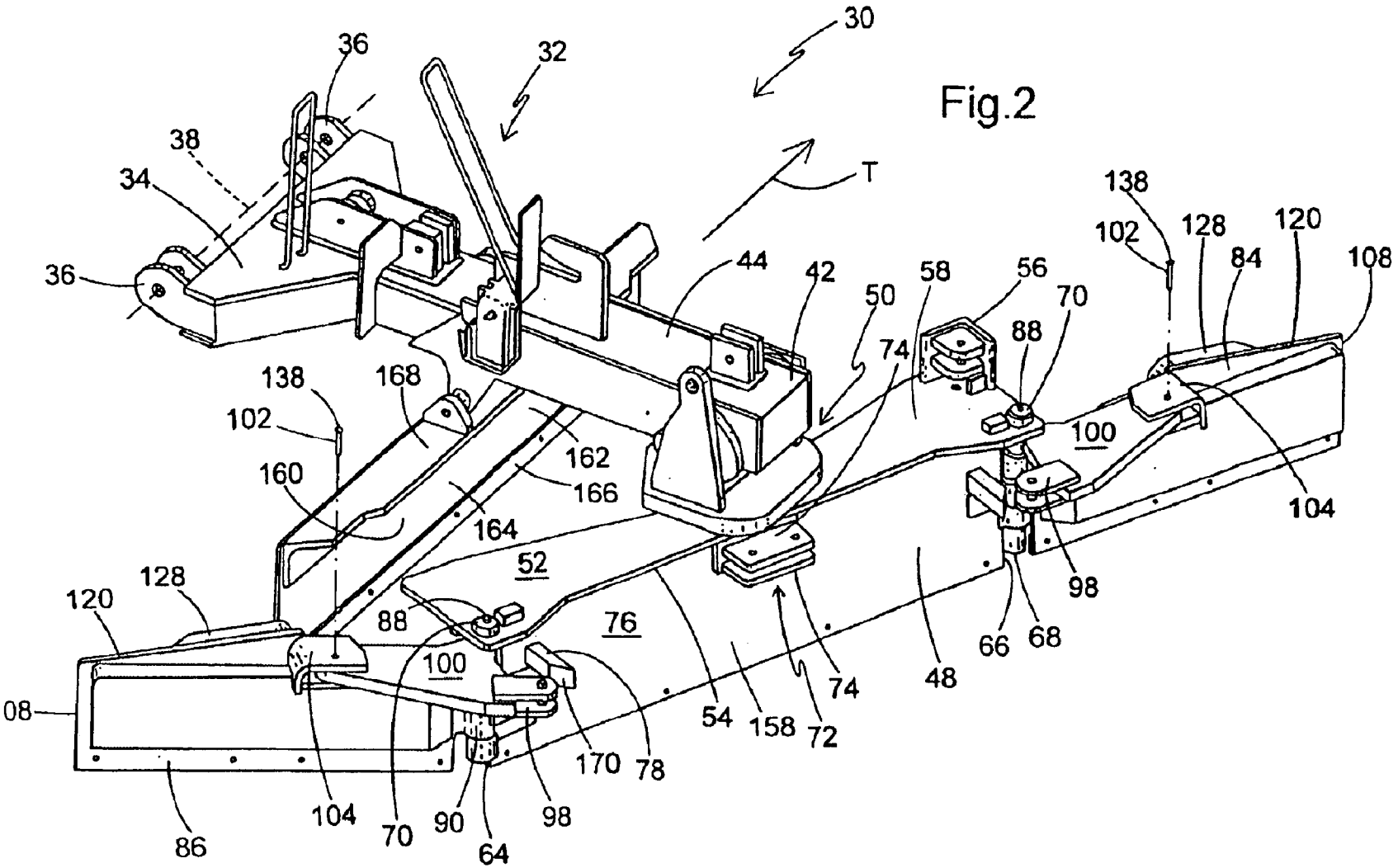
FIG. 2 is a top perspective view of the present wing assembly.
Figure 3:
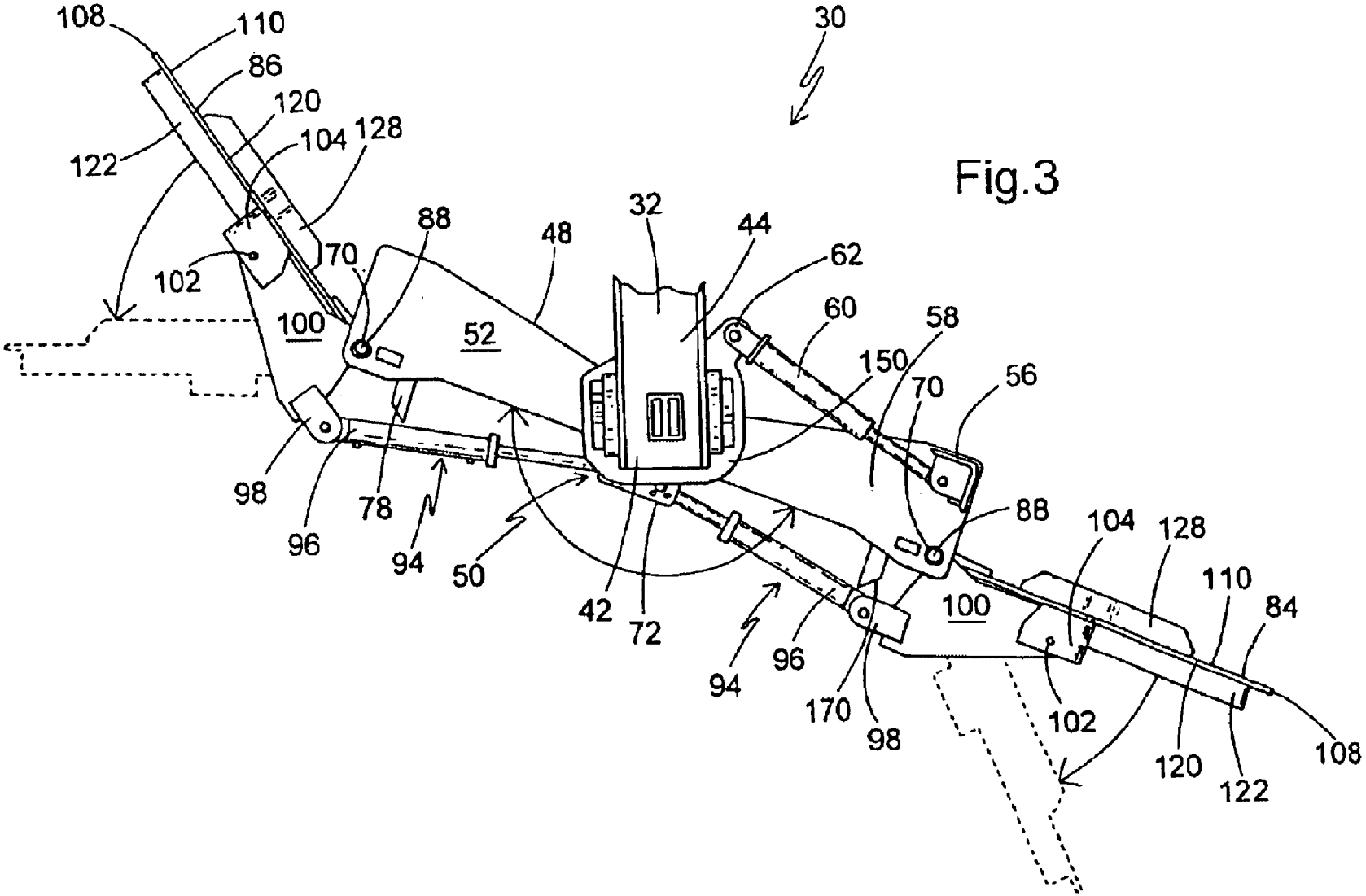
FIG. 3 is an overhead plan view of the present wing assembly with the template doors also shown broken away in phantom.

Referring now to FIGS. 1–3, the rail ballast wing assembly 30 includes a main support boom 32 which has a laterally flared inner end 34 provided with a clevis 36 forming a transverse pivot axis 38. The boom 32 is pivotally secured to the side 28 of the regulator 10 so that the elevation of the boom relative to the regulator may be adjusted. As is known in the art, a fluid power cylinder 40 secured to an outer end 42 of the boom 32 regulates the degree of pivoting/angle of elevation of the boom 32. As is seen in FIG. 1, a preferred angle of elevation is approximately 110–140° from vertical, so that a desired angle of slope of the ballast 22 is obtained. The angular orientation may vary to suit the application.

In the present application, it is to be understood that the regulator 10 may operate in either forward or reverse directions on the track 12. For clarity, the terms "front" and "rear" will refer to the orientation of the following components when the regulator 10 travels in the direction of the arrow "T" in FIG. 1.

More specifically, the boom 32 is actually made of two main components, the inner end 34, which is secured to the regulator 10, and an outer member 44 which is telescopically mounted to the inner end 34 for linear reciprocal movement relative thereto. In this manner, the outer end 42 of the boom can be extended or retracted for proper positioning relative to the ballast 22. The linear extension/retraction of the outer member 44 relative to the inner end 34 is controlled by at least one fluid powered cylinder 46 (best seen in FIG. 1). As is known in the art, sufficient friction reducing bushings and lubricant are provided to facilitate the telescoping action of the outer member 44 relative to the inner end 34.

An outer door 48 is pivotally secured to the boom 32 at a top plate assembly 50 which is secured to the outer member 44. A generally horizontally oriented shoulder plate 52 is fastened, such as by welding or other conventional fastening technology, to an upper edge 54 (best seen in FIG. 5) of the outer door 48. In the preferred embodiment, the shoulder plate 52 is generally hourglass shaped when viewed from above, however other shapes are contemplated depending on the application. A pivot control bracket 56 is provided on an upper surface 58 of the shoulder plate 52 and pivotably receives an end of a fluid-powered main outer door orientation cylinder 60 (best seen in FIG. 3). The opposite end of the cylinder 60 is secured to an eyelet 62 on the top plate assembly 50. Selective pressurization of the cylinder 60 causes extension or retraction, which in turn adjusts the angle of orientation of the outer door 48 to the side 28 of the regulator 10, the latter also approximating the longitudinal axis of the track 12.

Figure 6:
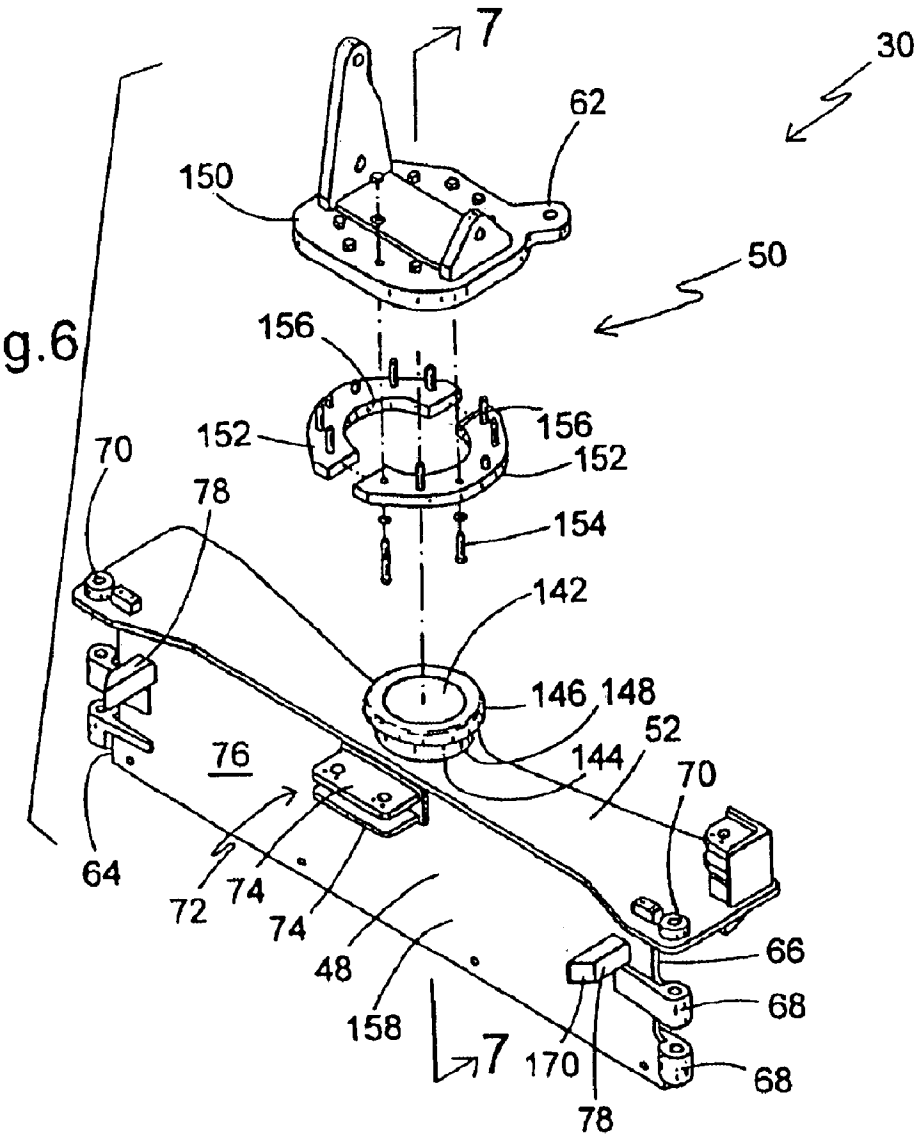
FIG. 6 is a top exploded perspective view of the present outer door with top plate.

Referring now to FIGS. 2, 3 and 6, the outer door 48 has at least one and preferably two hinge edges, which will be referred to in their relative position to the regulator 10 as a rear hinge edge 64 and a front hinge edge 66. Since the edges 64, 66 are substantially identical, only one will be described in detail. The front hinge edge 66 is provided with a pair of spaced, hinge bores 68 which are axially aligned with each other and also with a pivot pin aperture 70 located on the shoulder plate 52.

Also included on the outer door 48 is a template door cylinder attachment bracket 72, which in the preferred embodiment is a pair of spaced, generally parallel plates 74 secured to a rear surface 76 of the outer door 48, and at least one stop projection 78. An optional grader blade 80 may be attached to a front surface 82 (best seen in FIG. 5) of the outer door 48.

Referring now to FIGS. 2–5, at least one and preferably a pair of template doors 84, 86 are each pivotably secured to a corresponding one of the edges 64, 66. The template door pivoting movement occurs about an axis defined by a pivot pin 88 (best seen in FIG. 4) which passes through the pivot pin aperture 70 in the shoulder plate 52, also through the pivot bores 68 on the outer door 48, as well as through a like plurality of template door pivot bores 90 axially aligned and spaced along an adjacent hinge edge 92.

The relative angular orientation of each of the template doors 84, 86 relative to the outer door 48 is maintained by a positioning assembly 94 (best seen in FIG. 3), which includes at least one fluid power template door cylinder 96 connected at one end to the template door cylinder attachment bracket 72 and at the other end to a clevis bracket 98 located on a breakaway plate 100. The breakaway plate 100 in turn is pivotably secured to the template door 84, 86 by at least one shear pin 102 passing through the plate 100 and a breakaway bracket 104. In the preferred embodiment, the bracket 104 is dimensioned to receive an end 106 of the breakaway plate 100. Broadly speaking, the positioning assembly 94, working through selective pressurization of the template door cylinder 96, changes the angular orientation of the template door 84, 86 relative to the outer door 48.

An important feature of the present wing assembly 30 is that the breakaway mechanism, including the breakaway plate 100, the shear pin 102 and the bracket 104, is connected to the positioning assembly 94 and the corresponding template door 84, 86 for temporarily disengaging the template door from the positioning assembly upon exposure to impact forces. Basically, the breakaway plate 100 is configured to form a breakaway connection with the template door 84, 86, so that upon exposure to impact forces, the shear pin 102 breaks, freeing the template door 84, 86 from the fluid powered positioning assembly 94, allowing the template door to pivot freely relative to the outer door 48. In this manner, the template doors 84, 86 will be less susceptible to misaligning or deforming damage through impacts with immovable obstacles or debris in the ballast 22.

It will be seen that the breakaway plate 100 is generally triangular in shape when viewed from above (FIGS. 3–5), and at each corner forms an engagement point with one of the bracket 104 on the template door 84, 86, the template door pivot pin 88 and the positioning cylinder 96. Once the shear pins 102 become broken, the template doors 84, 86 break free from the positioning cylinder 96 (shown in phantom in FIG. 3).

Figures 4, 5:
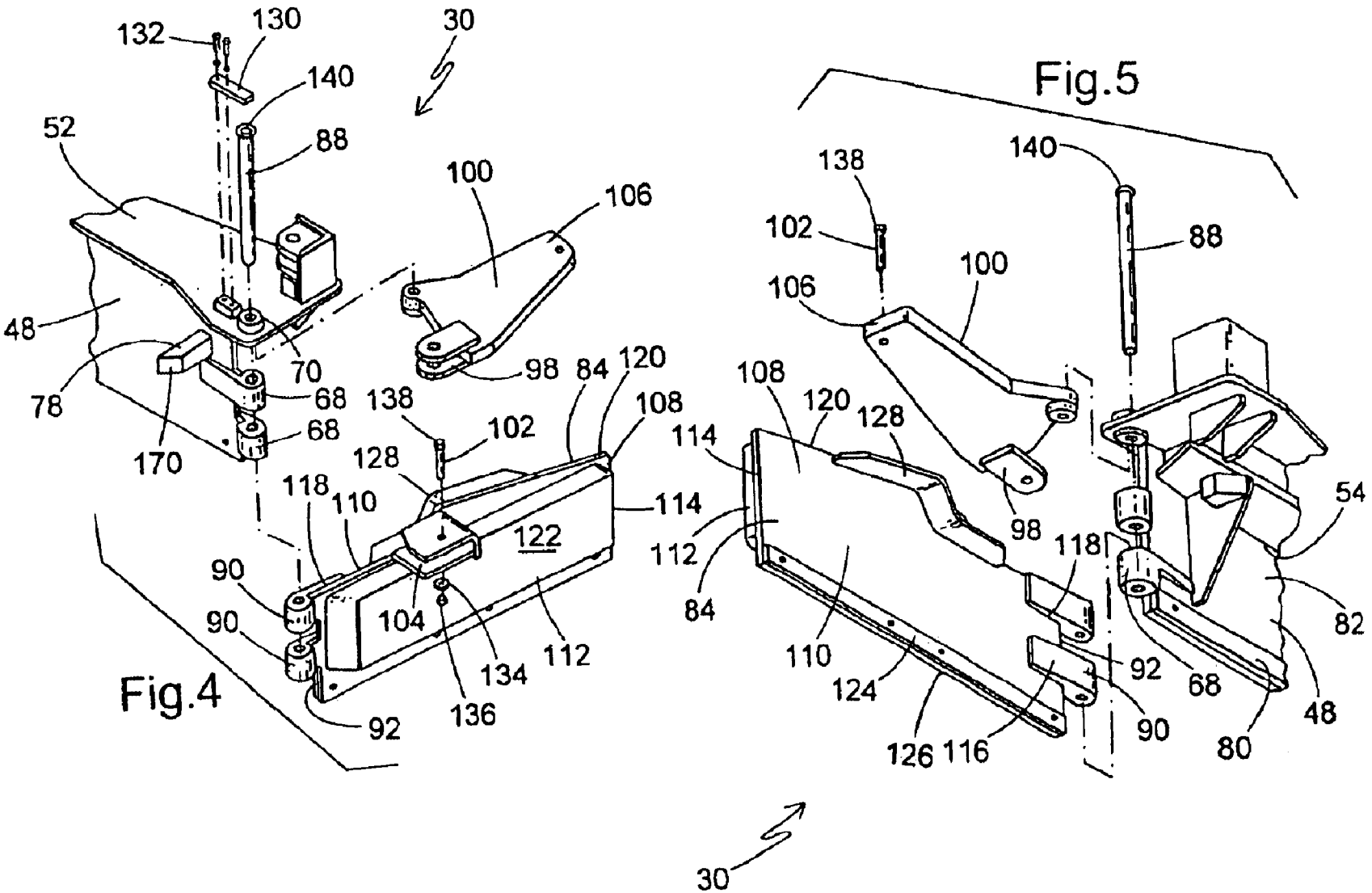
FIG. 4 is an exploded top perspective view of the present breakaway feature.
FIG. 5 is an exploded front perspective view of the present breakaway feature.

Referring now to FIGS. 4 and 5, the structure of each template door 84, 86 will be described in greater detail. Since the template doors 84, 86 are substantially identical, only one will be described. A main panel 108 has a generally planar inside or regulator-facing side 110, an outer side 112 and a free edge 114 opposite the hinge edge 92. Each of the template door pivot bores 90 located along the hinge edge 92 are positioned to alternate with the outer door pivot bores 68 to form a door hinge type relationship. In addition, to provide additional impact resistance, in the preferred embodiment, each of the template door pivot bores 90 is provided with a transversely extending reinforcement tab 116 for fastening to the template door. The tabs 116 extend along, and are secured to the inner side 110 of the template door at opposing planar surfaces 118, 110. Also, the breakaway bracket 104 projects rearwardly from the outer side surface 112 along an upper edge 120 of the main panel 108.

Projecting laterally from the outer side 112 is a generally rectangular-shaped support plate 122 which provides structural support to the template door 84. The plate 122 is preferably a separate sheet of steel which is formed and welded in place. In the preferred embodiment, the support plate 122 is substantially as wide as the template door, and has a height at least half a height of the template door. An optional detachable grader blade 124 disposed along a lower edge 126 of the template door 84 on the inner side 110. A forward projecting reinforcing plate 128 is also located along the upper edge 120 of the template door 84. In the preferred embodiment, to provide extra rigidity to the reinforcing plate 128, it is provided in a dogleg shape.

Referring now to FIG. 4, it will be seen that the template door pivot pin 88 is held in place with a detachable cap bracket 130, which is preferably held in place with at least one releasable fastener 132, such as a threaded bolt or screw. Other types of fastening technologies are contemplated, as is the possibility that the bracket is pivotable and swings out of the way to allow access to the pin 88. In addition, the shear pin 102 is held in place by a lock washer 134 and cap nut 136 or other threaded fastener, such as a locknut, as is known in the art. A head 138 of the shear pin 102 prevents it from falling through the bracket 104. Similarly, an enlarged head 140 is provided to the template door pivot pin 88.

Figure 7:
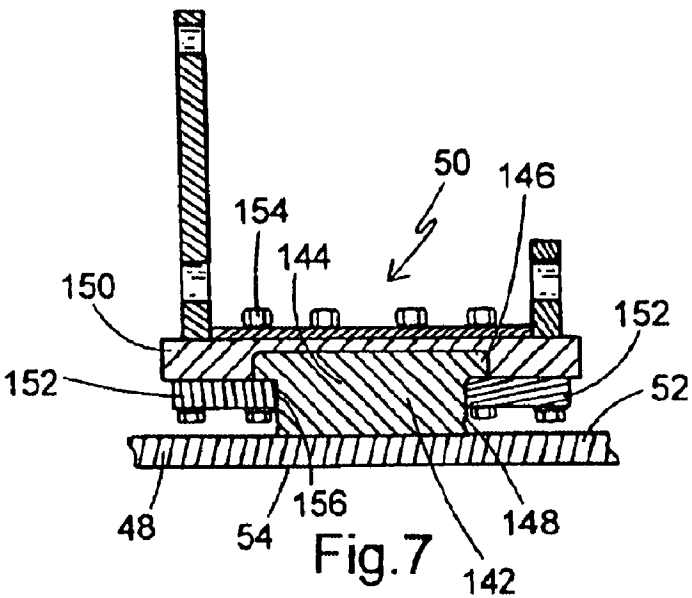
FIG. 7 is a vertical section of an assembled view of the present top plate assembly.

Referring now to FIGS. 6 and 7, the top plate assembly 50 will be described in greater detail. Generally, as is the case with the template doors 84, 86, the present top plate assembly 50 has also been strengthened to accommodate impact forces encountered by the template doors as well as the outer door 48 during the ballast regulating process. More specifically, the assembly 50 includes a top pin 142 secured along the upper edge 54 of the outer door 48 and specifically secured to the shoulder plate 52. The top pin 142 has a generally large diameter base 144, is substantially cylindrical in shape, and has a radially projecting upper lip 146 defining a space 148 between the lip and the shoulder 52.

A top plate 150 is pivotably secured to the top pin 142 by at least one and preferably two retaining plates 152 sandwiching the lip 146 between the retaining plate and the top plate. In the preferred embodiment, each of the retaining plates 152 is substantially "C" or banana-shaped and is secured to the top plate 150 by a plurality of fasteners 154, such as threaded bolts or the equivalent. Once the retaining plates 152 are secured to the top plate 150, an inner edge 156 of each plate 152 actually contacts and sandwiches the lip 146 therebetween so that the top pin 142 rotates relative to the top plate 150.

Referring now to FIGS. 2 and 6, the outer door 48 is secured to the main support boom 32 through the engagement between the top pin 142 and the top plate 150 described above. Upon assembly, a main wall 158 of the outer door 48 is disposed relative to the boom 32 so that the front surface 82 of the main wall faces the ballast 22 to be regulated, as well as the direction of travel T of the regulator 10. The angular orientation of the outer door 48 relative to the boom 32 is controlled by the main outer door orientation cylinder 60. To ensure that the ballast 22 is retained in the wing assembly 30 during ballast regulation, the template doors 84,86 are held in a designated orientation relative to the outer door 48 by the template door positioning cylinders 96. The innermost template door 86 forms a rough "C" or "U"-shaped enclosure for the retained ballast 22 by closing off a gap 160 (best seen in FIG. 2 ) between the outer door 48 and an inner door 162. The inner door 162 is disposed so that an elongate inner door surface 164 extends in the direction of travel T of the regulator 10, or generally parallel to the rails 14. In the preferred embodiment, the inner door 162 pivotably depends from the front or outward portion 44 of the boom 32, and is provided with a detachable grader blade 166. An upper edge, laterally projecting deflector flange 168 is also preferably provided.

Another preferable feature on the outer door 48 is that each of the preferably two rearwardly-projecting pivot stops 78, upon shearing of the shear pin 102 in response to a potentially damaging impact, prevent the template door 84, 86 from swinging back and smashing into the rear surface 76. In the preferred embodiment, each of the stops 78 is provided with an angled impact surface 170 to facilitate the retention of the free-swinging template door 84, 86 in an appropriately angled orientation.

During operation, as the regulator 10 moves in the direction of travel designated by the arrow T (best seen in FIGS. 1 and 2), in the event the wing assembly 30 encounters a fixed rigid object, or a large movable object in the ballast 22 such that the holding force exerted by the template door positioning cylinders 96 is overcome, the shear pins 102 break, causing the affected template doors 84, 86 to break free from the outer door 48 (shown in phantom in FIG. 3). The template doors 84, 86 thus pivot freely upon the template door pivot pin 88. In this way, the template doors 84, 86 are less likely to be damaged through such operational impacts. Likewise, the relatively substantial construction of the top pin 142 and the accompanying top plate 150 further withstands such impact damage.

While a particular embodiment of the present wing for rail ballast regulator with break-away feature has been described herein, it will be appreciated by those skilled in the art that changes and modifications may be made thereto without departing from the invention in its broader aspects and as set forth in the following claims.

What is claimed is:

1. A rail ballast wing assembly, comprising:

an outer door with at least one hinge edge;

a template door pivotably secured to said at least one hinge edge;

positioning means associated with said outer door and said template door for maintaining an angular orientation of said template door to said outer door;

a breakaway mechanism connected to said positioning means and said template door and configured for temporarily disengaging said template door from said positioning means upon exposure to impact forces, and upon said disengagement, said template door is configured to remain pivotably connected to said outer door.

2. The assembly of claim 1 wherein said positioning means is at least one fluid power cylinder secured at a first end to said outer door and at a second end to said template door so that changes in pressurization of said cylinder change the angular orientation of said template door to said outer door.

3. The assembly of claim 2 wherein said second end of said fluid power cylinder is connected to said template door through said breakaway mechanism.

4. The assembly of claim 1 wherein said breakaway mechanism is connected to said template door with at least one shear pin.

5. The assembly of claim 1 wherein said breakaway mechanism includes a plate pivotable relative to at least one of said outer door and said template door, and being configured to form a breakaway connection with said template door.

6. The assembly of claim 5 wherein said positioning means is a fluid power cylinder connected at one end to said outer door, and at a second end to said plate.

7. The assembly of claim 6 wherein said plate is connected to said template door by at least one shear pin.

8. The assembly of claim 7 wherein said template door is provided with a bracket defining a space for receiving said plate, and said plate is secured to said bracket by said at least one shear pin.

9. The assembly of claim 6 wherein said plate is pivotable relative to said template door and to said outer door, and pivots about a pivot axis formed by the junction of said template door and said outer door.

10. The assembly of claim 1 wherein said template door is provided with a plurality of spaced, aligned hinge bores, at least one of which has a transversely extending reinforcement tab for fastening to said template door.

11. The assembly of claim 10, wherein each said tab has a generally planar attachment surface configured for engaging a generally planar front surface of said template door.

12. The assembly of claim 1 wherein said template door is provided on a rear surface with a laterally extending support plate.

13. The assembly of claim 12 wherein said support plate is substantially as wide as said template door, and has a height at least half a height of said template door.

14. The assembly of claim 12, wherein said template door further includes a forward projecting reinforcing plate.

15. The assembly of claim 1 further including a top pin secured along an upper edge of said outer door, said top having a radially projecting upper lip and a top plate pivotably secured to said top pin by at least one retaining plate sandwiching said lip between said retaining plate and said top plate.

16. A template door configured for connection to an outer door of a rail ballast wing assembly having at least one hinge edge, said template door pivotably secured to said at least one hinge edge, a positioning means associated with the outer door and said template door for maintaining an angular orientation of said template door to the outer door, and a breakaway mechanism connected to the positioning means and said template door and configured for temporarily disengaging said template door from the positioning means upon exposure to impact forces, said template door comprising:

a main panel having a front side, a rear side, a free edge and a hinge edge;

a plurality of spaced, axially aligned hinge bores, each secured to said hinge edge with a transversely extending reinforcement tab for fastening to said template door;

at least one attachment point for receiving a positioning means for positioning the angular orientation of said template door to the outer door and a bracket projecting from said rear side and defining a space for receiving a breakaway plate, said bracket being configured for securing the plate by at least one shear pin.

17. The template door of claim 16, wherein said front side is generally planar and said tab has a generally planar attachment surface configured for engaging said generally planar front side of said template door.

18. The template door of claim 16 further including a laterally extending support plate.

19. The template door of claim 18 wherein said support plate is substantially as wide as said template door, and has a height at least half a height of said template door.

20. The template door of claim 16 further including a forward projecting reinforcing plate located along an upper edge of said template door.

21. An outer door for use with a rail ballast regulator having a boom and wing assembly with at least one said outer door having at least one template door pivotable relative to each said at least one outer door and a positioning means associated with said outer door and the template door for maintaining an angular orientation of the template door to said outer door, and a breakaway mechanism connected to the positioning means and the template door and configured for temporarily disengaging the template door from the positioning means upon exposure to impact forces, said outer door comprising:

a main wall having a front surface, a rear surface and a pair of hinge edges;

a generally perpendicularly disposed shoulder plate secured to an upper edge of said main wall;

a top pin secured to and projecting from said shoulder plate, said top pin having a radially extending upper lip defining a space between said lip and said shoulder plate; and a plurality of spaced, axially aligned hinge bores, secured to each said hinge edge with a transversely extending reinforcement tab for fastening to said wall, said hinge bores constructed and arranged for engaging corresponding bores on template doors associated with said outer door.

22. The outer door of claim 21 further including a hinge bore in said shoulder plate in registry with said axially aligned hinge bores.

23. The outer door of claim 21 further including pivot stops projecting from said rear surface for limiting the pivot action of the at least one template door.

24. The outer door of claim 21 further including a top plate pivotably secured to said lip by at least one retainer bracket which sandwiches said lip between said top plate and said bracket.

25. The outer door of claim 21 further including a mounting point for securing one end of a positioning means connected to a corresponding one of the template doors for adjusting and maintaining the position of the at least one template door relative to said outer door.

26. A rail ballast wing assembly, comprising:

a outer door with at least one hinge edge;

a template door pivotably secured to said at least one hinge edge;

positioning means associated with said outer door and said template door for maintaining an angular orientation of said template door to said outer door;

a breakaway mechanism connected to said positioning means and said template door and configured for temporarily disengaging said template door from said positioning means upon exposure to impact forces, and said breakaway mechanism includes a plate pivotable relative to at least one of said outer door and said template door, and being configured to form a breakaway connection with said template door.

* * * * *

UNITED STATES PATENT AND TRADEMARK OFFICE

CERTIFICATE OF CORRECTION

PATENT NO. : 6,883,436 B2
APPLICATION NO. : 10/446944
DATED : April 26, 2005
INVENTOR(S) : James W. Fuerst It is certified that error appears in the above-identified patent and that said Letters Patent is hereby corrected as shown below:

In the Claims:

Col. 8, lines 15-16, delete "said top having" and insert --said top pin having--

Signed and Sealed this
Twentieth Day of December, 2011

David J. Kappos

David J. Kappos
*Director of the United States Patent and Trademark Office*